US007225646B2

(12) United States Patent
Okamoto

(10) Patent No.: US 7,225,646 B2
(45) Date of Patent: Jun. 5, 2007

(54) METHOD OF KNITTING KNITWEAR WITH RAGLAN SLEEVES AND KNITWEAR WITH RAGLAN SLEEVES

(75) Inventor: Kazuyoshi Okamoto, Wakayama (JP)

(73) Assignee: Shima Seiki Mfg., Ltd., Wakayama (JP)

( * ) Notice: Subject to any disclaimer, the term of this patent is extended or adjusted under 35 U.S.C. 154(b) by 0 days.

(21) Appl. No.: 10/574,578

(22) PCT Filed: Sep. 27, 2004

(86) PCT No.: PCT/JP2004/014093

§ 371 (c)(1),
(2), (4) Date: Apr. 4, 2006

(87) PCT Pub. No.: WO2005/035849

PCT Pub. Date: Apr. 21, 2005

(65) Prior Publication Data

US 2007/0084252 A1 Apr. 19, 2007

(30) Foreign Application Priority Data

Oct. 8, 2003 (JP) ..... 2003-350133

(51) Int. Cl.
*D04B 7/10* (2006.01)

(52) U.S. Cl. ..... 66/176; 66/64

(58) Field of Classification Search ..... 66/176, 66/64, 69, 76, 169 R, 170, 171, 172 R
See application file for complete search history.

(56) References Cited

U.S. PATENT DOCUMENTS 5,916,272 A * 6/1999 Nonnenmacher et al. ..... 66/69
6,286,340 B1 * 9/2001 Yui ..... 66/70
6,658,899 B2 * 12/2003 Okamoto ..... 66/64

FOREIGN PATENT DOCUMENTS

EP 1 264 922 A1 12/2002

(Continued)

*Primary Examiner*—Danny Worrell
(74) *Attorney, Agent, or Firm*—Rothwell, Figg, Ernst & Manbeck, P.C.

(57) ABSTRACT

The present invention provides a knitting method for knitting knitwear having raglan sleeves and knitwear thus formed, wherein a beautiful silhouette is gained when being put on, which knitwear is knitted in a seamless manner by using a flat knitting machine.

It is a method of knitting knitwear with raglan sleeves formed by using a flat knitting machine, wherein the length of the back body is formed to be longer than the length of the front body. The sleeves and the front body are joined and then the sleeves and the back body are joined, while the bodies and the sleeves are knitted. After the sleeves and the front body are joined, the step 1 and step 2 are repeated. In the step 1, a boundary between the right and back parts of one side of the sleeve is placed between a pair of the front and back needle beds, and a neckline forming part of one side of the sleeve is knitted together with the back body, while a knitting width of the neckline forming part is narrowed by flechage knitting so that one side of the sleeve and the back body are joined. In the step 2, a boundary between the right and back parts of the other side of the sleeve is placed between a pair of the front and back needle beds, and the neckline forming part of the other side of the sleeve is knitted together with the back body, while a knitting width of the neckline forming part is narrowed by flechage knitting so that the other side of the sleeve and the back body are joined.

5 Claims, 12 Drawing Sheets

FOREIGN PATENT DOCUMENTS

| | | |
|---|---|---|
| GB | 2 228 750 A | 9/1990 |
| JP | 57-199844 | 12/1982 |
| JP | 2-229248 | 9/1990 |
| JP | 4-15301 | 9/1990 |
| WO | WO 01/55491 A1 | 8/2001 |
| WO | WO 01/55492 A1 | 8/2001 |

* cited by examiner

METHOD OF KNITTING KNITWEAR WITH RAGLAN SLEEVES AND KNITWEAR WITH RAGLAN SLEEVES

CROSS REFERENCE TO RELATED APPLICATION

This application is a 35 USC § 371 National Phase Entry Application from PCT/JP2004/014093, filed Sep. 27, 2004, and designating the United States.

TECHNICAL FIELD

The present invention relates to a method of knitting knitwear with raglan sleeves and knitwear with raglan sleeves.

BACKGROUND ART

In general, as shown in FIG. 4 of the Patent Document 1, knitwear with the raglan sleeves are knitted with the front and back bodies in such a manner that the hem part and the side parts are knitted, together with the slant-line parts being formed while being inclined straight toward the neckline from the upper end part of the side parts. The sleeves are knitted in such a manner as to cover one's arms and shoulders when knitwear is put on, wherein the joining-line parts for joining the slant-line parts of the body to the sleeves are knitted and on the upper end part of the sleeves there is formed a part of the neckline.

In case of the sweater with the raglan sleeves, for instance, as shown in FIG. 14, front body 91, back body 92 and both sleeves 93 are each knitted in a tubular form, in respect of the part of the area A from the hem part of the front body 91 and the back body 92 to a little bit before gores 94 on the lower part of a armhole. Then, after knitting the gores 94 on the lower part of the armhole, in respect of the area B from the gores 94 through the slant-line part 95 to a little bit before the neckline of the front body, the front body 91, the back body 92 and the sleeves 93 are joined in order to make them tubular. As a neckline is made, so-called returning steps of making it in the shape of the letter C are made so that the front body 91, the back body 92 and the sleeves 93 are joined (referring to the region C). After the front body 91, the back body 92 and the sleeves 93 are joined, a neckline comprising the front body 91, the back body 92 and the upper end part of the sleeves 93 as continuous parts is made.

Patent Document 1: Public Gazette showing the Patent Publication No. Heisei 4-15301 (FIG. 4)

DISCLOSURE OF THE INVENTION

Problems to be Solved by the Invention

When knitwear is made by using a flat knitting machine to make it seamless, the back knitted fabric and the front knitted fabric are knitted in a tubular form to be made in a continuous manner by using the back and front needle beds of the flat knitting machine. For instance, in the flat knitting machine with two needle beds, back and front, alternate needles on each of the front and back needle beds are used to knit a tubular knitwear having the sleeves, wherein odd needles of the front needle bed are used mainly for knitting the front body and the front parts of the sleeves and even needles of the back needle bed are used mainly for knitting the back body and the back parts of the sleeves.

Then, when the shape of the fabric is not symmetric from each other between the front body and the back body or when the knitting width is different, a new loop is formed on an old loop in which the old loop at the end of the knitting width of the front knitted fabric remains shifted to the needle of the even number on the back needle bed. When the new loop is formed on the old loop, the old loop of the front knitted fabric that has been shifted remains twisted while providing bad appearance.

For this reason, when the flat knitting machine is used, the loops need to be formed with boundary parts between the front knitted fabric and the back knitted fabric placed between a pair of the front and back needle beds, Therefore, in order that the boundary parts between the front knitted fabric and the back knitted fabric are always placed between the back and front needle beds, the knitting width of the back and front knitted fabrics should always be the same as being looped. Also in the case of the knitwear with the raglan sleeves as shown in FIG. 14, the front body 91 and the back body 92 have the same width of the body, the same width of the slant-line parts and the same height, wherein the sleeves 93 have the front and back knitted fabrics that are the same form in respect of the boundary line.

However, in case of the knitwear with the raglan sleeves, when the neckline of the front body is made largely open while the front and back fabrics have the same width, the neckline of the back body remain largely dragged down when the completed sweater is put on. On the other hand, when the neckline of the front body is relatively small as trying to pull down the back neckline as little as possible, the slant-line parts remain pulled up to a place near the shoulder, when the completed sweater is put on.

In consideration of the circumstance mentioned above, the present invention has been developed. It is an object of the present invention to provide a method of knitting seamless knitwear with raglan sleeves beautifully silhouetted when put on, knitted by using a flat knitting machine, and to provide that same knitwear.

MEANS FOR SOLVING PROBLEMS

In the method of knitting knitwear with raglan sleeves of the present invention, the knitwear with raglan sleeves is knitted by using a flat knitting machine having at least a pair of front and back needle beds extending in a transverse direction and disposed opposite to each other in a cross direction, at least either of which is capable of being racked in the transverse direction so that loops can be transferred between the front and back needle beds.

In other words, in the method of knitting knitwear of the present invention, a length of the back body is formed to be longer than a length of the front body. Furthermore, while knitting the body and the sleeves, the sleeves and the front body are joined, wherein the sleeves and the back body are joined also.

Furthermore, after the sleeves and the front body are joined, step 1 and step 2 are repeated as shown below. In the step 1, with a boundary between a front sleeve part and a back sleeve part located on one side placed between a pair of the front and back needle beds, a neckline forming part of the sleeve on the one side is knitted together with the back body, while a knitting width of the neckline forming part is narrowed by flechage knitting, so that the sleeve on the one side and the back body are joined. In the step 2, with a boundary between a front sleeve part and a back sleeve part located on other side placed between a pair of the front and back needle beds, the neckline forming part of the sleeve on the other side is knitted together with the back body, while a knitting width of the neckline forming part is narrowed by flechage knitting, so that the sleeve on the other side and the back body are joined.

As a result of the knitwear being formed in this manner, when knitwear is put on, the back side of the neckline remains without being dragged down, wherein the front side of the neckline is large and the slant-line parts of the body are capable of being extended from a place below the shoulder toward the side.

To be more specific, in the step 1, after the boundary of the sleeve on the one side is placed between a pair of the front and back needle beds by rotating a body and at least one of right and left sleeves in one direction on the flat knitting machine, the back body and the sleeve on the one side are knitted, while being joined together. On the other hand, in the step 2, after the boundary of the sleeve on the other side is placed between a pair of the front and back needle beds by rotating a body and at least the other of right and left sleeves in the opposite direction on the flat knitting machine, the back body and the sleeve on the other side are knitted, while being joined together.

By doing the rotation of the knitting wherein the twisted loop is not formed in the sleeves, the loop appears more beautiful.

Furthermore, in the method of knitting knitwear with raglan sleeves of the present invention, gore parts are formed on at least on a front knitted fabric of the front and back bodies and sleeves, wherein in case of forming the gore parts on the front and back knitted fabrics, the gore parts of the front knitted fabric of the front body and sleeves are preferably formed larger in size than the gore parts of the back knitted fabric of the back body and sleeves At this moment, before completion of the joining of the sleeves and the front body, the following step a and step b are repeated. In the step a, after the boundary of the sleeve on the one side is placed between a pair of the front and back needle beds by rotating a body and at least one of right and left sleeves in one direction on the flat knitting machine, the bodies and the sleeve on the one side are knitted, while being joined together. In the step b, after the boundary of the sleeve on the other side is placed between a pair of the front and back needle beds by rotating a body and at least the other of right and left sleeves in the opposite direction on the flat knitting machine, the bodies and the sleeve on the other side are knitted, while being joined together.

By forming the gores in this way, the sleeves and the body are joined while the sleeves are extended toward ahead of the body so that knitwear is silhouetted beautifully as being put on.

Knitwear with raglan sleeves of the present invention is characterized by being knitted by using a flat knitting machine having at least a pair of front and back needle beds which are arranged to extend in a transverse direction and disposed opposite to each other in a cross direction, and at least either of which is capable of being racked in the transverse direction so that loops can be transferred between the front and back needle beds, wherein the body having the tubular sleeves and the side parts are knitted in a seamless manner and the body and the sleeves are joined in a seamless manner, so that the length of the back body is formed to be longer than the length of the front body, wherein the neckline forming parts of the sleeves are formed in a slanted manner by flechage knitting.

Knitwear of the present invention does not have the back part of the neckline dragged down when being put on and the front part of the neckline remain largely open. In addition, the slant-line parts of the body remain extended from a place below the shoulder toward the side.

At this moment, when the gore parts are formed on at least on the front knitted fabric of the front and back bodies and sleeves, wherein in case of forming the gore parts on the front and back knitted fabrics, the gore parts of the front knitted fabric of the front body and sleeves may preferably be formed larger in size than the gore parts of the back knitted fabric of the back body and sleeves. Thus, as the gore parts of different sizes of the back and the front parts are formed, knitwear is more beautifully silhouetted when being put on.

BEST MODE FOR CARRYING OUT THE INVENTION

An embodiment of knitwear with raglan sleeves and an embodiment of a method thereof according to the present invention will be described with reference to the accompanying drawing.

In the illustrated embodiment, knitwear is knitted by using a so-called two-bed flat knitting machine comprising a pair of front and back needle beds extending in a transverse direction and disposed opposite to each other in a cross direction, the back needle bed being capable of being racked in the transverse direction so that loops can be transferred between the front and back needle beds.

In the two-bed flat knitting machine, alternate needles on each of the front and back needle beds are used to knit a tubular knitwear. For example, odd needles of the front needle bed are used mainly for knitting front parts of the knitwear, such as the front body and front parts of the sleeves, and even needles of the back needle bed are used mainly for knitting back parts of the knitwear, such as the back body and back parts of the sleeves.

Further, needles on one of the front and back needle beds which confront the knitting needles on the other needle bed are used as empty needles. The empty needles are used for transference of loops and for the rib knitting and the like.

Using the empty needles can allow a structure pattern of mixed front and back stitches, such as links, purl stitches, and ribs to be knitted and can also allow the loops of the sleeves and the bodies to move in a direction of course so as to join them to each other.

When the two-bed flat knitting machine is used, a transfer jack bed arranging transfer jacks thereon may be disposed over either or both of the front and back needle beds, to knit a knitted fabric.

In the illustrated embodiment, the two-bed flat knitting machine is used to knit knitwear. According to the present invention, a four-bed flat knitting machine comprising an upper front needle bed, a lower front needle bed, an upper back needle bed, and a lower back needle bed may alternatively be used to knit the knitwear.

When the four-bed flat knitting machine is used to knit knitwear, for example front knitted fabric parts are supplied to the lower front needle bed, and back knitted fabric parts are supplied to the lower back needle bed. Then, when knitting the front knitted fabric parts, the needles of the upper back needle bed are used as empty needles for transference of loops of the front knitted fabric parts. When knitting the back knitted fabric parts, needles of the upper front needle bed are used as empty needles for transference of loops of the back knitted fabric parts.

THE FIRST EMBODIMENT

First of all, as one of the most preferred embodiment of the present invention, the first embodiment will be explained with reference to FIG. 1 to FIG. 6.

The first embodiment shows a method of knitting body and sleeves of knitwear using the two-bed flat knitting machine so that the body and sleeves can be formed into a seamless and continuous tubular form, wherein the above body and sleeves are joined in a seamless manner. The first embodiment also shows the knitwear knitted by the same knitting method.

FIG. 1 shows the plan view of the parts of the bodies and the sleeves of the sweater 1 of the knitwear knitted by the knitting method of the present invention. FIG. 2 shows a knitting process drawing when forming the B part in FIG. 1. FIG. 3 shows a knitting process drawing when forming the C part in FIG. 1. FIG. 4 shows a knitting process drawing when forming the D part in FIG. 1. FIG. 5 shows a knitting process drawing when forming the D part in FIG. 1, wherein it shows a knitting process drawing, which is carried out after the knitting process in FIG. 4. FIG. 6 shows a knitting process drawing when forming the E part in FIG. 1.

The sweater 1 knitted in this illustrated embodiment has a long raglan sleeves and a round-necked neckline. The sweater 1 has a front body 2, a back body 3, a right sleeve 4 and a left sleeve 5. Each of the bodies 2, 3, as shown in FIG. 1 has a hem part 61, side parts 62, gore parts 63, slant-line parts 64 and a neckline 65 (65*a*, 65*b*). The front body 2 and the back body 3 have a different shape on the upper side of the knitting area B, as shown in FIG. 1. The slant-line parts 64 are extended in a slant manner from the neckline 65 to gore parts 63.

Furthermore, the front body 2 and the back body 3 have a same shape while knitting the hem part 61, the side parts 62, the gore parts 63, and the slant-line parts 64 before the neckline 65 starts to be formed, wherein the back body 3 is formed to be longer than the front body 2 on its upper part of the neckline 65*a*.

The right and left sleeves 4,5 have, as shown in FIG. 1, cuff parts, 71 gore parts 72, slant-line joined parts 73 and neckline forming parts 74. Each of the sleeves 4,5 has symmetrical shape against the back and front centerlines x shown in FIG. 1, wherein the cuff parts 71 reach to the neckline forming parts 74. However, the neckline forming parts 74 are slant at the end of the front knitting part wherein flechage knitting is carried out.

According to the illustrated embodiment, as shown in FIG. 1, the knitting area A from the hem part 61 to the gore parts 63 of the bodies 2,3 and from the cuff parts 71 to the gore parts 72 of the sleeves 4,5, the bodies 2,3 and the sleeves 4,5 are knitted individually in a tubular form.

Furthermore, after completion of the joining of the gore parts 63 of the bodies 2,3 and the gore parts 72 of the sleeves 4,5, one tubular body is knitted. Regarding the knitting area B from the gore parts 63, 72 to the neckline being formed, the bodies 2,3 and the sleeves 4,5 are joined while the bodies 2,3 and the sleeves 4,5 are knitted.

Furthermore, when the neckline 65*a* of the front body 2 starts to be knitted, the front body 2 is divided into the left front body part 22 and the right front body part 21, regarding the knitting area C before completion of knitting of the front body 2. Thus, while the bodies 2,3 and the sleeves 4,5 are knitted, each of the bodies 2,3 and the sleeves 4,5 are joined.

After the front body 2 is formed, the sleeves 4,5 and the back body 3 are joined while the sleeves 4,5 and the back body 3 are knitted. Then, the neckline forming parts 74 of the sleeves 4,5 are formed in a slant manner, wherein the sleeves 4,5 are knitted to get narrower in respect of the sleeve width from the front side to the back side. In FIG. 1, the knitting area forming the neckline forming parts 74 before completion of the knitting of the front sides of the sleeves 4,5 is referred to as D, wherein another knitting area forming the neckline forming parts 74 after completion of the knitting of the front sides of the sleeves 4,5 is referred to as E.

Then, after the sleeves 4,5 and the bodies 2,3 are joined, the neckline is formed, wherein the neckline 65 of the bodies 2,3 and the neckline forming parts 74 of the sleeves 4,5 are joined in a continuous way. On the other hand, in the illustrated embodiment and the second embodiment which will be explained next, the terms, "right" and "left", used for the body and the sleeves, like the left sleeve 5 and the right sleeve 4, indicate the right-hand side and the left-hand side of the knitwear as viewed from a wearer who wears the sweater 1.

The steps for knitting the sweater 1 of this embodiment will be described in detail. In this embodiment, the back body 3, a right back sleeve 42 and a left back sleeve 52 are knitted mainly with even needles on the back needle bed and the front body 2, a right front sleeve 41 and a left front sleeve 51 are knitted mainly with odd needles on the front needle bed.

Furthermore, in the illustrated embodiment and the second embodiment, for convenience of explanation, the front body 2, the back body 3, and the sleeves 4,5 of the sweater 1 are knitted in a plain knitting pattern, and the hem parts 61 of the bodies 2,3 and cuff parts 71 of the sleeves 4,5 are knitted in a rib knitting pattern. Alternatively, the front body 2, the back body 3 and the sleeves 4,5 may be knitted in a jacquard knitting pattern or a rib knitting pattern.

First, a tubular body and tubular right and left sleeves are knitted by repetition of the knitting step of feeding a knitting yarn to the needles for knitting the front knitted fabric from a body and sleeves knitting use yarn feeder (not shown) and then feeding the knitting yarn therefrom to the needles for knitting the back knitted fabric, while reversing the yarn feeder.

In the knitting area A according to FIG. 1, the front body 2 and the back body 3 are knitted in tubular form from their hem part 61 to the gore parts 63. The left front sleeve 51 and the left back sleeve 52 as well as the right front sleeve 41 and the right back sleeve 42 are knitted in a tubular form from the cuff parts 71 to the gore parts 72. Specifically, the hem part 61 and the cuff parts 71 are knitted by rib knitting.

In the sweater 1, the gore parts 63 of the front body 2 are joined to the gore parts 72 of the left front sleeve 51 and the right front sleeve 41, while the gore parts 63 of the back body 3 are joined to the gore parts 72 of the left back sleeve 52 and the right back sleeve 42. When the bodies 2,3 and the sleeves 4,5, start being joined together, the bodies 2,3 and the sleeves 4,5 are combined to form a single tubular body. When each of the gore parts gets joined, there is given the state of the step 1 as shown in FIG. 2. In the knitting process drawing from FIG. 2 to FIG. 6, there is shown the order of the knitting process from below to above.

Then, in the knitting area B, while the bodies 2,3 and the sleeves 4,5 are knitted, the slant-line parts 64 of the bodies 2,3 and the slant-line joined parts 73 of the sleeves 4,5 are joined. In the knitting in the knitting area B as shown in FIG. 2, the right back sleeve 42, the back body 3 and the left back sleeve 52 are knitted one course on the back needle bed B from the state of the step 1 (Step 2). From this state, the left front sleeve 51, the front body 2 and the right front sleeve 41 are knitted one course on the front needle bed F (Step 3). Afterwards, the same kind of steps is repeated as the step 2 and the step 3.

Furthermore, in the knitting process drawings, m indicates the boundary between the front body 2 and the sleeves 4,5, and n indicates the boundary between the back body 3 and the sleeves 4,5, wherein h1 indicates the boundary between the front and back parts of the right sleeve 4 and h2 indicates the boundary between the front and back parts of the left sleeve 5.

Each of the right back sleeve 42 and the right front sleeve 41 are joined one loop to the loop of the end of the back and front bodies 2,3, wherein each of the left back sleeve 52 and the left front sleeve 51 are joined one loop to the loop of the end of the back and front bodies 2,3 (Step 4.). This joining step is carried out, wherein the loops of the sleeve are moved to the opposite needle bed, and wherein the loops are moved two needles distance inside so that the loops are returned to the original needle bed. After joining step, the right back sleeve 42, the back body 3 and the left back sleeve 52 are knitted one course (Step 5). From this state, the left front sleeve 51, the front body 2 and the right front sleeve 41 are knitted one course (Step 6).

Afterwards, after repeating the same movement of the step 5 and the step 6, each side of the front body 2 and each side of the back body 3 have one loop each decreased (Step 7). Thus, each of the front and back bodies 2,3 has two loops less. Afterwards, the same steps from the step 2 to the step 7 are repeated.

In this way, after two courses are knitted in respect of the front and back knitted fabric, the loops of the sleeves 4,5 are joined to the bodies 2,3, and then after two courses are knitted in respect of the front and back knitted fabric, the loops of the bodies 2,3 are decreased. And these steps are repeated so that the knitting area B can be finished, thus constituting the step 8.

The knitting of the knitting area C will be explained with reference to FIG. 3. In the state of the step 8, the center part of the front body 2 is a part of the neckline 65*a*, and while the part is held on the needle on the front needle bed F (step 8 in FIG. 3), the bodies 2,3 and the sleeves 4,5 are joined while they are knitted.

First, on the back needle bed B, the right back sleeve 42, the back body 3 and the left back sleeve 52 are knitted one course (Step 9). Next, on the front needle bed F, the left front sleeve 51 and the left front body part 22 are knitted two courses (Step 10). On the back needle bed B, the left back sleeve 52, the back body 3 and the right back sleeve 42 are knitted one course (Step 11).

The loops of the left back sleeve 52 and the left front sleeve 51 are joined to the loops of the end of the back and front bodies 2,3 loop by loop (Step 12). This joining step is carried out by moving the knitted fabric of the sleeve to the opposite side needle bed, wherein the knitted fabric is moved two needles distance inside so that the knitted fabric is be returned to the original needle bed.

Subsequently, on the front needle bed F, the right front sleeve 41 and the right front body part 21 are knitted two courses (Step 13). On the back needle bed B, the right back sleeve 42, the back body 3 and the left back sleeve 52 are knitted one course (Step 14). The loops of the right back sleeve 42 and the right front sleeve 41 are joined to the loops of the end of the back and front bodies 2,3 loop by loop (Step 15). According to this joining step, the fabric part of the sleeve is moved to the opposite side needle bed, wherein the knitted fabric is moved two needles distance inside so that the knitted fabric can be returned to the original needle bed.

On the front needle bed F, the left front sleeve 51 and the left front body part 22 are knitted by flechage knitting (Step 16). By this flechage knitting, the neckline 65 is formed while the knitting width of the left front body part 22 is decreased. On the back needle bed B, the left back sleeve 52, the back body 3 and the right back sleeve 42 are knitted one course (Step 17). The loop of the left side end of the front body 2 and the loop of the left side end of the back body 3 are decreased by one loop each (Step 18).

On the front needle bed F, the right front sleeve 41 and the right front body part 21 are knitted by flechage knitting (Step 19). By this flechage knitting, the neckline 65 is formed while the knitting width of the right front body part 21 is decreased. On the back needle bed B, the right back sleeve 42, the back body 3 and the left back sleeve 52 are knitted one course (Step 20). The loop of the right side end of the front body 2 and the loop of the right side end of the back body 3 are decreased by one loop each (Step 21).

Furthermore, subsequent steps from the step 10 to the step 21 are repeated involving the same motion. In this way, the motion from the step 9 to step 21 is repeated until the knitting area C is knitted so that the state of the step 22 is given, wherein all loops of the front body 2 held on the front needle bed F constitute the neckline 65*a*.

From the state of the step 22, the knitting process goes to the knitting area D as shown in FIG. 4 and FIG. 5. For the convenience of the explanation, in FIG. 4, the knitting width is more broadly shown than the step 22 as shown in FIG. 3. In the knitting area D, the sleeves 4,5 are joined to the back body 3, while the sleeves 4,5 and the back body 3 are knitted, with all the loops of the front body 2 being held on the needle of the front needle bed F.

First, from the state of the step 22 shown in FIG. 4, the left front sleeve 51 is knitted two courses (Step 23), and subsequently the left back sleeve 52 is knitted two courses (Step 24). At the next stage, the left front sleeve 51 is knitted by flechage knitting so that the loops of the neckline forming parts 74 are held on the needles while the knitting loops of the left front sleeve 51 are decreased (Step 25). The loop of the left back sleeve 52 is joined to the loop of the end of the back body 3 (Step 26).

The left back sleeve 52 and the back body 3 are knitted two courses (Step 27). The loop of the left side end of the back body 3 is decreased by one loop (Step 28). By this decrease of the loop, the knitting state is given the state of the step 29. The point a of the step 29 shows the boundary between the knitting part of the left front sleeve 51 and the knitting part of the neckline forming parts 74.

At the next stage, the right front sleeve 41 is knitted two courses (Step 30). And to follow, the right back sleeve 42 is knitted two courses (Step 31). Subsequently, the right front sleeve 41 is knitted by flechage knitting so that that the loops of the neckline forming parts 74 are held on the needles while the knitting loops of the right front sleeve 41 is decreased (Step 32). The loop of the right back sleeve 42 is joined to the loop of the end of the back body 3 (Step 33).

The right back sleeve 42 and the back body 3 are knitted two courses (Step 34). The loop of the right side end of the back body 3 is decreased by one loop (Step 35). By this decrease of the loop, the knitting state is given the state of the step 36. The point b in the step 36 shows the boundary between the knitting part of the right front sleeve 41 and the knitting part of the neckline forming parts 74.

Subsequently, as shown in FIG. 5, from the state of the step 36, the whole knitted fabric part is rotated clockwise so that the boundary h2 between the back and front parts of the left sleeve 5 is be placed between the back and front needle beds (Step 37). As a result, at the final course of the left sleeve 5, the formation of twist in the loop does not occur.

Thus, from the state of the step 37, the left front sleeve 51 is knitted two courses (Step 38), and subsequently the left back sleeve 52 is knitted two courses (Step 39). At the next stage, the left front sleeve 51 is knitted by flechage knitting so that the loops of the neckline forming parts 74 are held on the needles while the knitting loops of the left front sleeve 51 are decreased (Step 40). The loop of the left back sleeve 52 is joined to the loop of the end of the back body 3 (Step 41). The left back sleeve 52 and the back body 3 are knitted two courses (Step 42). The loop of the left side end of the back body 3 is decreased by one loop (Step 43). By decreasing the loop, the knitting state is given the state of the step 44.

Subsequently, from the state of the step 44, the whole knitted fabric part is rotated anticlockwise, wherein the boundary h1 between the back and front parts of the right sleeve 4 is placed between the back and front needle beds (Step 45). As a result, at the final course of the right sleeve 4, the formation of twist in the loop does not occur.

Consequently, from this state, the right front sleeve 41 is knitted two courses (Step 46), and subsequently the right back sleeve 42 is knitted two courses (Step 47). At the next stage, the right front sleeve 41 is knitted by flechage knitting so that the loops of the neckline forming parts 74 are held on the needles while the knitting loops of the right front sleeve 41 are decreased (Step 48). The loop of the right back sleeve 42 is joined to the loop of the end of the back body 3 (Step 49). The right back sleeve 42 and the back body 3 are knitted two courses (Step 50). The loop of the right side end of the back body 3 is decreased by one loop (Step 51). By decreasing the loop, the knitting state is given the state of the step 52.

Thus, the motion from the step 37 to the step 52 is repeated until the knitting area D is knitted so that the knitting state of the step 53 is given. In the step 53, all the loops of the front body 2 held on the front bed needle F constitute the neckline 65*a*, wherein all the loops of the left and right sleeve front parts 41, 51 held on the front bed needle F constitute the neckline forming parts 74.

From the state of the step 53, the knitting process goes to the knitting area E as shown in FIG. 6. In the knitting area E, the sleeve back parts 42, 52 are joined to the back body 3, while the sleeve back parts 42, 52 and the back body 3 are knitted, with all loops of the front body 2 and the loops of the left and right sleeve front parts 41, 51 being held on the needle bed. For the convenience of the explanation, in FIG. 6, the knitting width is more broadly shown than the step 53 as shown in FIG. 5.

In the knitting of the knitting area E shown in FIG. 6, the left back sleeve 52, the back body 3 and the right back sleeve 42 are knitted two courses on the back needle bed B starting from the state of the step 53 (Step 54). The loop of the right back sleeve 42 is joined to the loop of the end of the back body 3 by one loop (Step 55). The left back sleeve 52, the back body 3 and the right back sleeve 42 are knitted one course (Step 56). The loop of the left back sleeve 52 is joined to the loop of the end of the back body 3 by one loop (Step 57). The right back sleeve 42, the back body 3 and the left back sleeve 52 are knitted one course (Step 58). The right side end of the back body 3 is decreased by one loop (Step 59). The left back sleeve 52, the back body 3 and the right back sleeve 42 are knitted one course (Step 60). The left side end of the back body 3 is decreased by one loop (Step 61). The right back sleeve 42, the back body 3 and the left back sleeve 52 are knitted one course (Step 62).

Furthermore, the motion from the step 55 to the step 62 is repeated until the knitting of the knitting area E is finished. When the knitting of the knitting area E is finished, the knitting state is given the state of the step 63 so that the neckline is made in such a manner that the neckline 65*a* of the front body 2, the neckline 65*b* of the back body 3 and the neckline forming parts 74 are made in a continuous way. According to the present embodiment, the length of the neckline 65*a* of the front body 2 is made larger than that of the neckline 65*b* of the back body 3. Afterwards, after the neckline is formed, the neck is formed to complete the sweater.

In addition, according to the knitting shown in FIG. 6, every time one course is knitted, the loop at one side of the right and left is decreased, however, the number of transferring loops may be decreased to the minimum times when knitting. Specifically, regarding one of the front fabrics of the left and right sleeves, for instance, the left sleeve, all loops of the front fabric of the left sleeve held on the back needle bed are transferred to the front needle bed. Keeping this state, furthermore, the back fabric of the left sleeve and back body are transferred to the front needle bed, wherein the right sleeve held on the back needle bed is racked to the left sleeve side so that the back fabric of the left sleeve and the back body are returned to the back needle bed in such a manner that the right sleeve and the back body are joined. On this occasion, the loop of the end of the right sleeve held on the front needle bed has to be transferred to the back needle bed.

Furthermore, the back body and the back fabric of the sleeve are knitted so that only the back fabric of the left sleeve is transferred to the front needle bed, wherein the right sleeve and the back body held on the back needle bed are racked to the left sleeve side in such a manner that the back fabric of the left sleeve is returned to the back needle bed and thus, the left sleeve and the back body are joined. On this occasion, the loop of the end of the right sleeve held on the front needle bed is transferred to the back needle bed.

On the other hand, as the range of racking is limited, the loops of the front fabric of the left sleeve held on the front needle bed are returned to the back needle bed in the middle step, wherein this time, the loops may be transferred in the same way in respect of the right sleeve and while racking is carried out in the opposite direction, knitting and joining steps may be thus carried out. Thus, by repeating the steps of knitting and joining, the repeated transferring of the same loops are saved so that the loops can be damaged as little as possible.

According to the first preferred embodiment, when knitwear is put on, the neckline of the front body is largely dragged down, wherein the neckline of the back body is not dragged down.

THE SECOND EMBODIMENT

The second embodiment will be explained with reference to FIG. 7 to FIG. 10

According to the second embodiment, knitwear is knitted using the two-bed flat knitting machine. The second embodiment is added some elements to the first preferred embodiments, the length of the gore parts 63*a*, 72*a* provided on the front body 2 and the sleeve front parts 41, 51 are made larger than the length of the gore parts 63*b*, 72*b* provided on the back body 3 and the sleeve back part 42, 52.

FIG. 7 shows the plan view of the parts of the bodies and the sleeves of the sweater 1 of the knitwear according to the second embodiment. In FIG. 7, the right sleeve is omitted.

FIG. 8 shows the knitting process drawing when forming the B part in FIG. 7. FIG. 9 shows the knitting process drawing when forming the C part in FIG. 7. FIG. 10 shows the knitting process drawing when forming the D part in FIG. 7.

The sweater 1 knitted in this embodiment has a long raglan sleeves and a round-necked neckline. The sweater 1 has the front body 2, the back body 3, the right sleeve 4 and the left sleeve 5. Each of the bodies 2, 3, as shown in FIG. 7 has a hem part 61, side parts 62, gore parts 63*a*, 63*b*, slant-line parts 64 and a neckline 65. In FIG. 7, the front body 2 and the back body 3 have the different knitting width and length above the gore parts 63*a*, 63*b*. The slant-line parts 64 are extended in a slant manner from the gore parts 63*a*, 63*b* toward the neckline 65.

Furthermore, the front body 2 and the back body 3 have the same slant angle in respect of the slant-line parts 64, wherein the size of the gore parts 63*a* on the front part is made larger than the gore parts 63*b* on the back part so that the knitting width of the front body 2 is narrower than that of the back body 3. In addition, in the same way as in the first embodiment, the back body 3 is made to be longer than the front body 2 on its upper part of the neckline 65*a*.

As shown in FIG. 7, the left and right sleeves 4,5 comprise the cuff parts 71 the gore parts 72*a*, 72*b*, the slant-line joining parts 73 and the neckline forming parts 74. Each of the sleeves 4,5 has symmetrical shape against the back and front centerlines x shown in FIG. 7 as far as the sleeve reaches from the cuff parts 71 to the gore parts 72*a*, 72*b*, wherein the sleeve front parts 41, 51 have the gore parts 72*a* larger than the gore parts 72*b* of the sleeve back parts 42, 52 so that the knitting widths of the sleeve front part 41, 51 are narrower than the width of the sleeve back parts 42, 52. Furthermore, the neckline forming parts 74 are slant at the end of the front knitting part wherein flechage knitting is carried out.

According to the present preferred embodiment, as shown in FIG. 7, the knitting area A from the hem part 61 to the gore parts 63*a*,63*b* of the bodies 2,3 and from the cuff parts 71 to the gore parts 72*a*,72*b* of the sleeves 4,5, the bodies 2,3 and the sleeves 4,5 is knitted individually in a tubular form.

Furthermore, after completion of the joining of the gore parts 63*a*, 63*b* of the bodies 2,3 and the gore parts 72*a*, 72*b* of the sleeves 4,5, one tubular body is knitted. Regarding the knitting area B from the gore parts 63*a*, 63*b*, 72*a*, 72*b* to the neckline being formed, the bodies 2,3 and the sleeves 4,5 are joined while the bodies 2,3 and the sleeves 4,5 are knitted.

Furthermore, when the neckline 65*a* of the front body 2 starts to be knitted, the front body 2 is divided into the left front body part 22 and the right front body part 21, regarding the knitting area C before completion of knitting of the front body 2. Thus, as the bodies 2,3 and the sleeves 4,5 are knitted, each of the bodies 2,3 and the sleeves 4,5 are joined.

After the knitting of the front body 2 is finished, the sleeves 4,5 and the back body 3 are joined, while the sleeves 4,5 and the back body 3 are knitted. Then, the neckline forming parts 74 of the sleeves 4,5 are made in a slant way as the widths of the sleeves from the front part to the back part get narrower. In FIG. 7, the knitting area forming the neckline forming parts 74 before the sleeve front parts 41, 51 are knitted is referred to as D, wherein another knitting area forming the neckline forming parts 74 after the sleeve front parts 41, 51 are knitted are referred to as E. Afterwards, after completion of the joining of the sleeves 4,5 and the bodies 2,3, the neckline is formed, wherein the neckline 65 of the bodies 2,3 and the neckline forming parts 74 of the sleeves 4,5 are joined in a continuous way.

The steps for knitting the sweater 1 of the second embodiment are described. First of all, a tubular body and tubular right and left sleeves are knitted by repetition of the knitting step of feeding a knitting yarn to the needles for knitting the front knitted fabric from a body and sleeves knitting use yarn feeder (not shown) and then feeding the knitting yarn therefrom to the needles for knitting the back knitted fabric, while reversing the yarn feeder.

In the knitting area A according to FIG. 7, the front body 2 and the back body 3 are knitted in a tubular form from their hem part 61 to the gore parts 63*a*, 63*b*. The left front sleeve 51 and the left back sleeve 52 as well as the right front sleeve 41 and the right back sleeve 42 are knitted in a tubular form from the cuff parts 71 to the gore parts 72*a*, 72*b*.

In the sweater 1, the gore parts 63*a* of the front body 2 are joined to the gore parts 72*a* of the left front sleeve 51 and the right front sleeve 41, while the gore parts 63*b* of the back body 3 are joined to the gore parts 72*b* of the left back sleeve 52 and the right back sleeve 42. When the bodies 2,3 and the sleeves 4,5, start being joined together, the bodies 2,3 and the sleeves 4,5 are combined to from a single tubular body. When each of the gore parts gets joined, there is given the state of the step 1 as shown in FIG. 8.

Then, in the knitting area B, while the bodies 2,3 and the sleeves 4,5 are knitted, the slant-line parts 64 of the bodies 2,3 and the slant-line joined parts 73 of the sleeves 4,5 are joined. In the knitting in the knitting area B shown in FIG. 8, from the state of the step 1, the whole knitted fabric part is rotated anticlockwise, wherein the boundary h2 between the back and front parts of the left sleeve 5 is placed between the back and front needle beds (Step 2). As a result, at the final course of the left sleeve 5, the formation of twist in the loop does not occur.

Furthermore, from the state of the step 2, the left front sleeve 51 is knitted two courses (Step 3), and to follow, the left back sleeve 52 is knitted two courses (Step 4). The loop of the left front sleeve 51 and the left back sleeve 52 are joined to the loop of the end of the back and front body 2,3 by one loop each (Step 5). On the next step, the left front sleeve 51 and the front body 2 are knitted two courses (Step 6).

The left back sleeve 52 and the back body 3 are knitted two courses (Step 7). The loops of the left side end of the front body 2 and the back body 3 are decreased by one loop each (Step 8). By this decrease of the loop, the knitting state is given the state of the step 9. Subsequently, from the state of the step 9, the whole knitted fabric part is rotated clockwise so that the boundary h1 between the front of the right sleeve 4 and the back of the right sleeve 4 is placed between the back and front needle beds (Step 10). As a result, at the final course of the right sleeve 4, the formation of twist in the loop does not occur.

From this condition, the right front sleeve 41 is knitted two courses (Step 11), and to follow, the right back sleeve 42 is knitted two courses (Step 12). The loop of the right front sleeve 41 and the right back sleeve 42 are joined to the loop of the end of the back and front bodies 2,3 by one loop each (Step 13).

On the next step, the right front sleeve 41 and the front body 2 are knitted two courses (Step 14). The right back sleeve 42 and the back body 3 are knitted two courses (Step 15). The right side end of the front body 2 and the back body 3 are decreased by one loop each (Step 16). By this decrease of the loop, the knitting state is given the state of the step 17.

Furthermore, the motion from the step 2 to the step 17 is repeated until the knitting area B is knitted so that the state of the knitting is given the state of the step 18.

The knitting of the knitting area C will be explained with reference to FIG. 9. In the state of the step 18, the center part of the front body 2 is a part of the neckline 65*a*, and while the part is held on the needle on the front needle bed F (step 18 in FIG. 9), the bodies 2,3 and the sleeves 4,5 are joined while they are knitted.

At first, as shown in FIG. 9, from the state of the step 18, the whole knitted fabric part is rotated anticlockwise so that the boundary h2 between the right and back parts of the left sleeve 5 is placed between the back and front needle beds (Step 19). As a result, at the final course of the left sleeve 5, the formation of twist in the loop does not occur.

Subsequently, in the step 19, the left front sleeve 51 and the left front body part 22 are knitted two courses (Step 20), and on the next step, the left back sleeve 52 is knitted two courses (Step 21). The loops of the left front sleeve 51 and the left back sleeve 52 are joined to the loops of the end of the back and front bodies 2,3 by one loop each (Step 22). On the next step, the left front sleeve 51 and the left front body part 22 are knitted by flechage knitting, wherein the loop for knitting the left front body part 22 is decreased by one loop so that the loop to make the neckline 65 is held on the needle (Step 23).

The left back sleeve 52 and the back body 3 are knitted two courses (Step 24). The loops of the left side end of the front body 2 and the back body 3 are decreased by one loop each (Step 25). By this decrease of the loop, the knitting state is given the state of the step 26. Subsequently, from the state of the step 26, the whole knitted fabric part is rotated clockwise so that the boundary h1 between the right and back parts of the right sleeve 4 is placed between the back and front needle beds (Step 27). As a result, at the final course of the right sleeve 4, the formation of twist in the loop does not occur.

From this condition, the right front sleeve 41 and the right front body part 21 are knitted two courses (Step 29), and to follow, the right back sleeve 42 is knitted two courses (Step 29). The loop of the right front sleeve 41 and the right back sleeve 42 are joined to the loop of the end of the back and front bodies 2,3 by one loop each (Step 30).

On the next step, the right front sleeve 41 and the right front body part 21 are knitted by flechage knitting, wherein the loops of the neckline 65 are held on the needles while the knitting loops of the right front body part 21 are decreased (Step 31). The right back sleeve 42 and the back body 3 are knitted two courses (Step 32). The loops of the right side end of the front body 2 and the back body 3 are decreased by one loop (Step 33). By this decrease of the loop, the knitting state is given the state of the step 34.

Furthermore, the motion from the step 19 to the step 34 is repeated until the knitting area C is knitted so that the state of the knitting is given the state of the step 35. According to the step 35, all the loops of the front body 2 held on the front needle bed F become the neckline 65*a*.

From the state of the step 35, the knitting process goes to the knitting area D as shown in FIG. 10. For the convenience of the explanation, in FIG. 10, the knitting width is more broadly shown than the step 35 as shown in FIG. 9. In the knitting area D, the sleeves 4,5 are joined to the back body 3, while the sleeves 4,5 and the back body 3 are knitted, with all the loops of the front body 2 being held on the needle of the front needle bed F.

At first, from the state of the step 35 as shown in FIG. 10, the whole knitted fabric part is rotated anticlockwise, wherein the boundary h2 between the back and front parts of the left sleeve 5 is placed between the back and front needle beds (Step 36). As a result, at the final course of the left sleeve 5, the formation of twist in the loop does not occur.

Subsequently, in the step 36, the left front sleeve 51 is knitted two courses (Step 37), and the left back sleeve 52 is knitted two courses (Step 38). The loop of the left back sleeve 52 gets joined to the loop of the end of the back body 3 by one loop (Step 39). The left front sleeve 51 is knitted by flechage knitting so that the loops of the neckline forming parts 74 are held on the needles while the knitting loops of the left front sleeve 51 are decreased (Step 40). The left back sleeve 52 and the back body 3 are knitted two courses (Step 41). The loop of the left side end of the back body 3 is decreased (Step 33). By this decrease of the loop, the knitting state is given the state of the step 43.

Subsequently, from the state of the step 43, the whole knitted fabric part is rotated clockwise so that the boundary h1 between the right and back parts of the right sleeve 4 is placed between the back and front needle beds (Step 44). As a result, at the final course of the right sleeve 4, the formation of twist in the loop does not occur.

From this condition, the right front sleeve 41 is knitted two courses (Step 45) and subsequently, the right back sleeve 42 is knitted two courses (Step 46). The loop of the right back sleeve 42 is joined to the loop of the end of the back body 3 by one loop (Step 47). The right front sleeve 41 is knitted by flechage knitting so that the loops of the neckline forming parts 74 are held on the needles while the knitting loops of the right front sleeve 41 are decreased (Step 48). The right back sleeve 42 and the back body 3 are knitted two courses (Step 49). The loop of the right side end of the back body 3 is decreased (Step 50). By this decrease of the loop, the knitting state is given the state of the step 51.

Furthermore, the motion from the step 36 to the step 51 is repeated until the knitting area D is knitted so that the state of the knitting is given the state of the step 52. According to the step 52, all the loops of the front body 2 held on the front needle bed F become the neckline 65, and all the loops of the right and left sleeve front part 41, 51 held on the front needle bed F become the neckline forming parts 74.

From the state of the step 52, the knitting process goes to the knitting area E as shown in FIG. 7. Regarding the knitting area E, explanation is omitted, as it is knitted in the same manner as in the first embodiment.

According to the second embodiment, the back part of the neckline does not have to be dragged down when being put on, wherein the gore parts of the front knitted fabric is made larger than the gore parts of the back knitted fabric in such a manner that the sleeves are extended toward ahead of the body in a slant way forward and the sleeve and the body get joined in order that the silhouette appears more beautiful when knitwear is put on.

Furthermore, knitwear with raglan sleeves and its knitting method according to the present invention comprise various forms and sizes of the back and front bodies 2,3 as in other embodiments shown in drawings from FIG. 11 to FIG. 13.

According to the third embodiment shown in FIG. 11, for instance, when the neckline is completed, the back and front bodies 2,3 are set to be made of such a size that the boundary h2 between the right and back parts of the sleeve 5 is placed between the back and front needle beds as shown in FIG. 11(*b*).

According to the fourth embodiment shown in FIG. 12, when the neckline is completed, the back and front bodies 2,3 are set to be made of such a size that the boundary h2 between the right and back parts of the sleeve 5 is placed on the front needle bed as shown in the FIG. 12(*b*).

Furthermore, according to the fifth embodiment shown in FIG. 13, when the neckline is completed in the second embodiment as mentioned above, the back and front bodies 2,3 are set to be made of such a size that the boundary h2 between the right and back parts of the sleeve 5 is placed on the back needle bed as shown in FIG. 13(*b*), however, the difference of length between the back body and the front body is made larger than in the case of the second embodiment.

In addition, the present invention can be realized with knitwear having so-called parachute design, wherein, around the shoulder above both sides, the joining lines to be overlapped each of the adjacent loops are radiated in all directions from the opening of the neck as a center.

INDUSTRIAL APPLICABILITY

The present invention is suitable for knitting seamless knitwear with raglan sleeves by using a flat knitting machine.

BRIEF DESCRIPTION OF DRAWINGS

FIG. 10 shows the knitting process drawing of the knitwear of the second embodiment according to the present invention, showing the knitting process drawing of knitting the part D in FIG. 7.

FIG. 14 shows the plan view of the parts of the body and the sleeve of the usual sweater having raglan sleeves Explanations of Letters or Numerals

Figure 1:
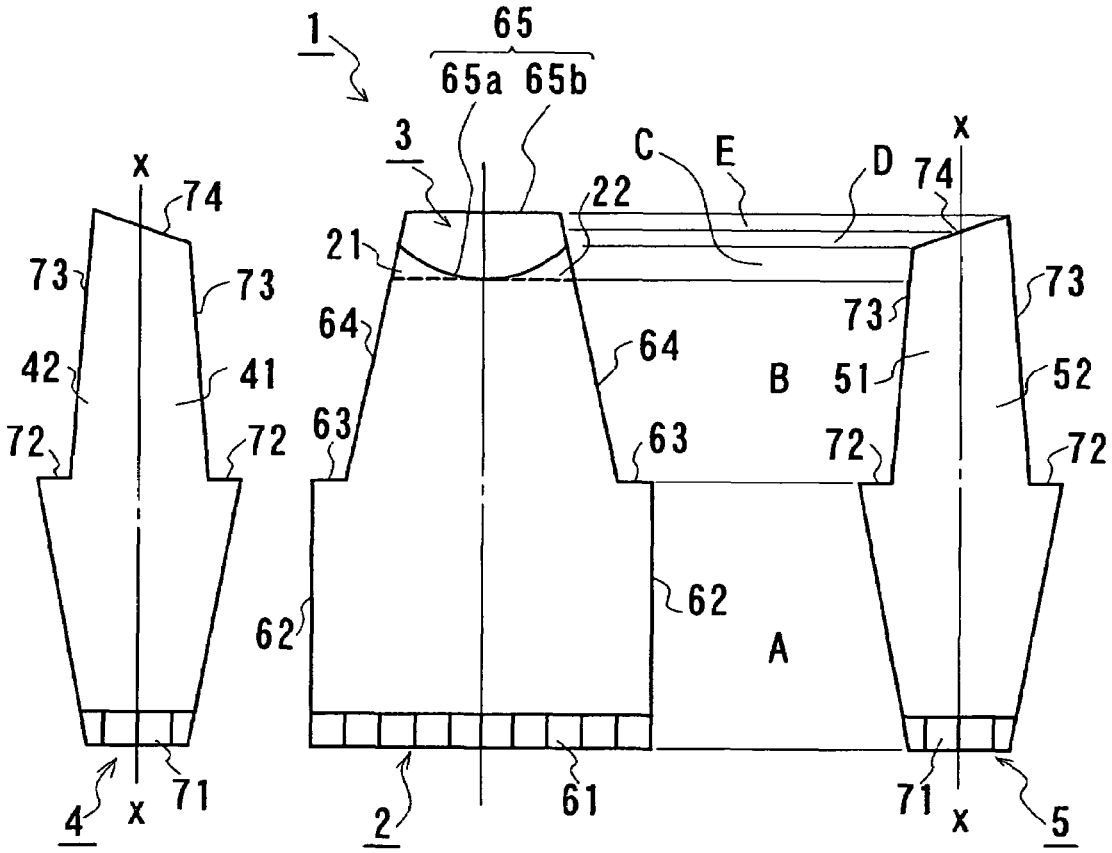
FIG. 1 shows the first embodiment of the knitwear according to the present invention, showing the plan view of the parts of bodies and sleeves of the sweater.
Figure 2:
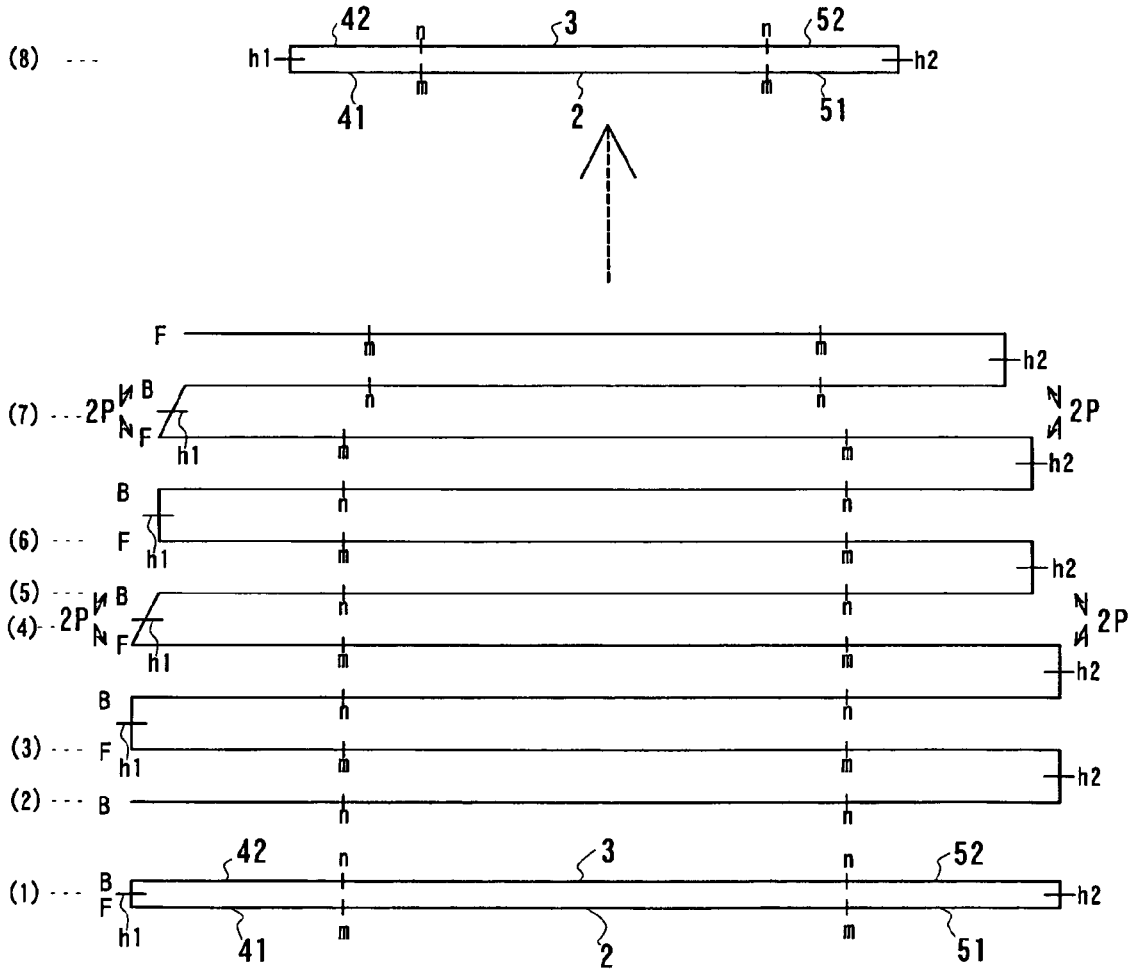
FIG. 2 shows the knitting process drawing of the knitwear of the first embodiment according to the present invention, showing the knitting process drawing of knitting the part B in FIG. 1.
Figure 3:
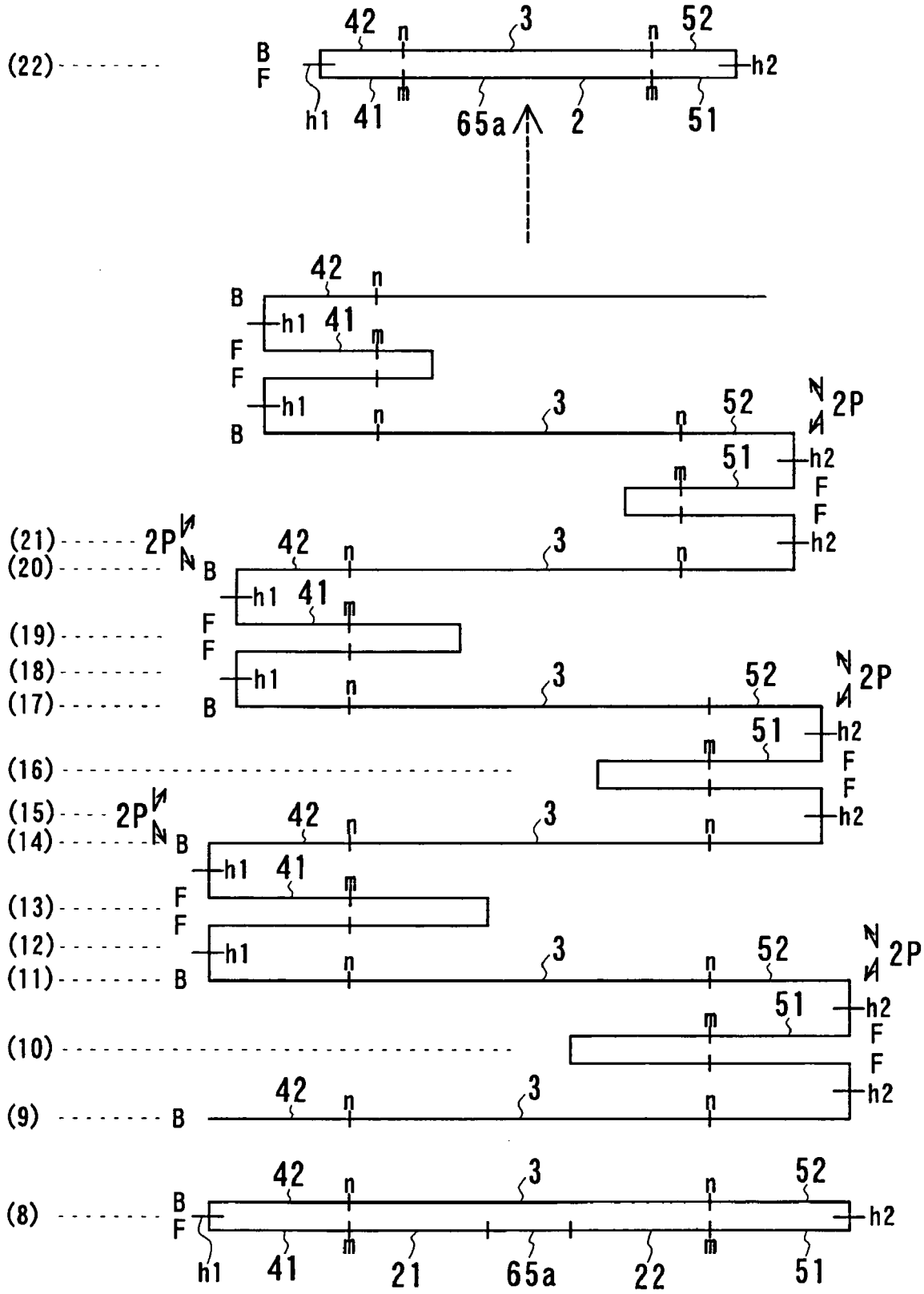
FIG. 3 shows the knitting process drawing of the knitwear of the first embodiment according to the present invention, showing the knitting process drawing of knitting the part C in FIG. 1.
Figure 4:
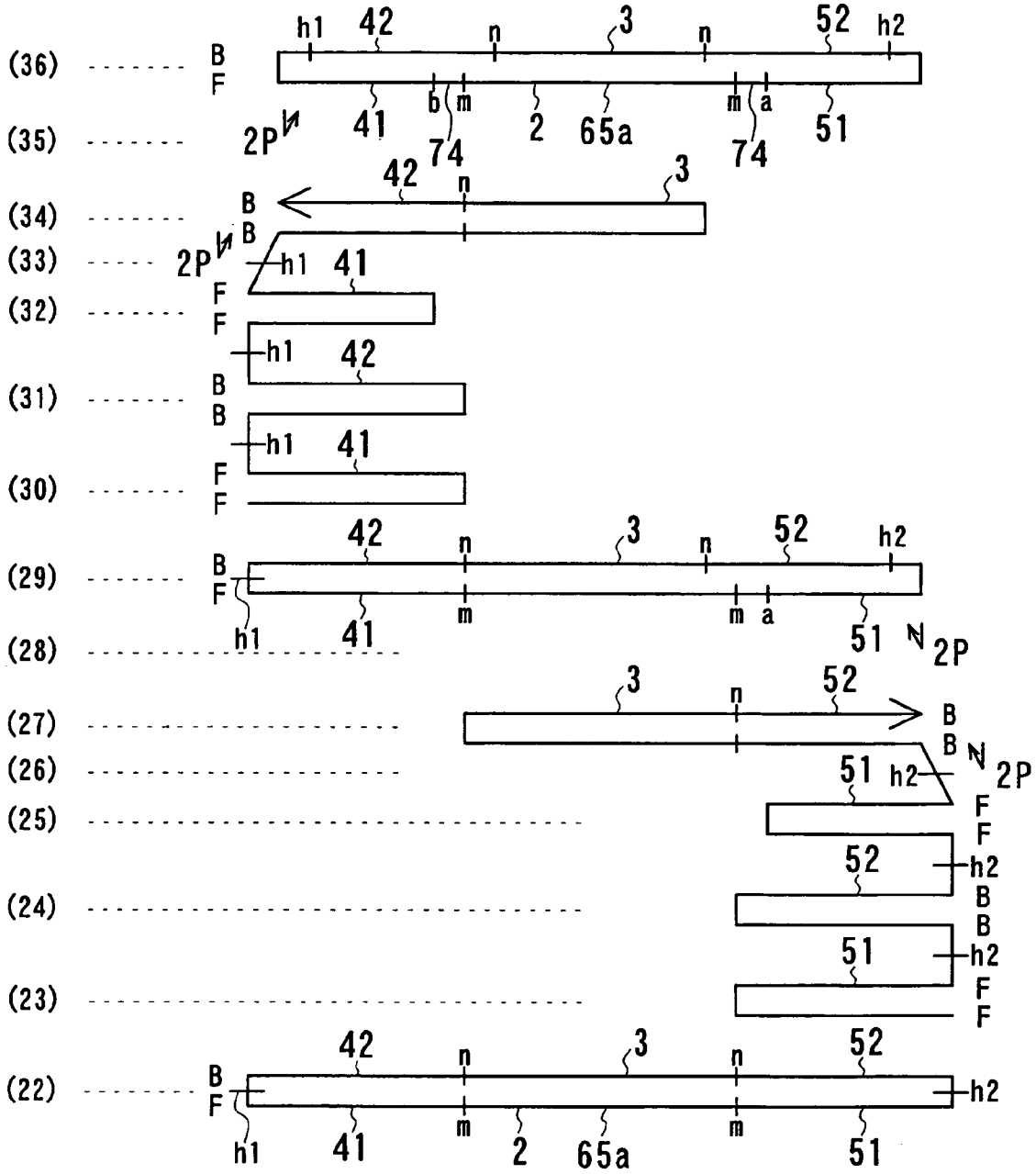
FIG. 4 shows the knitting process drawing of the knitwear of the first embodiment according to the present invention, showing the knitting process drawing of knitting the part D in FIG. 1.
Figure 5:
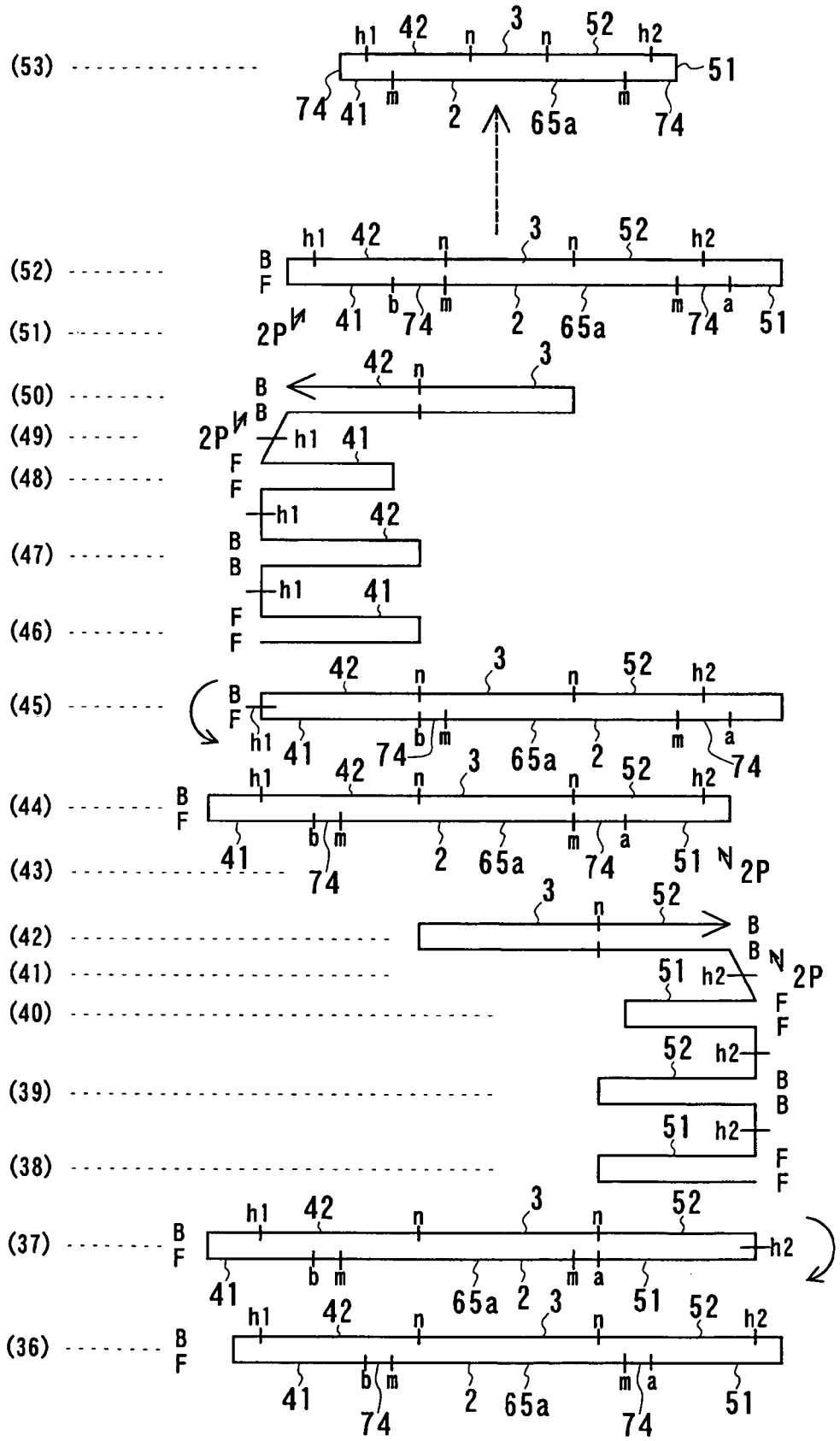
FIG. 5 shows the knitting process drawing of the knitwear of the first embodiment according to the present invention, showing the knitting process drawing of knitting the part D after knitting in FIG. 4.
Figure 6:
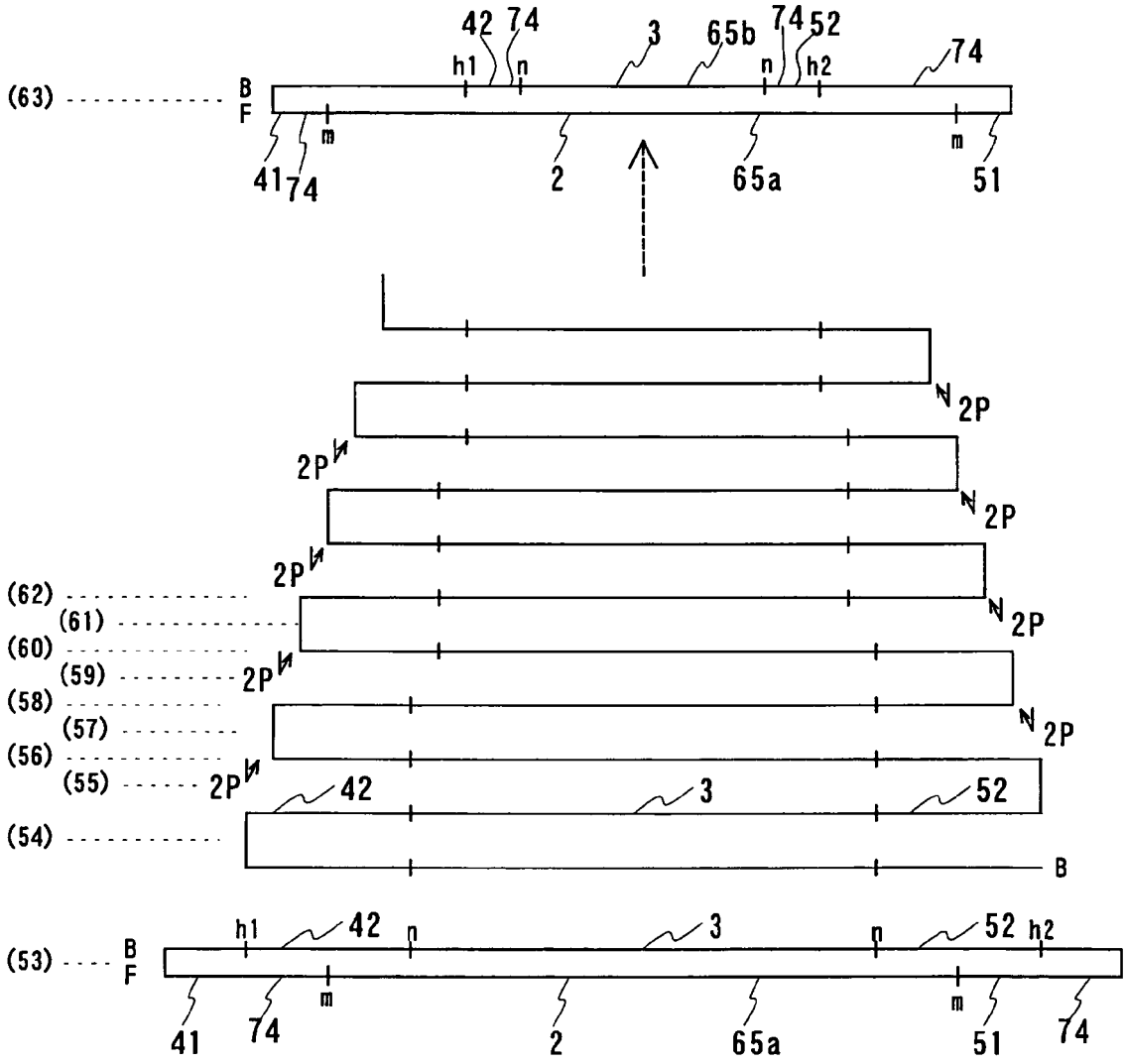
FIG. 6 shows the knitting process drawing of the knitwear of the first embodiment according to the present invention, showing the knitting process drawing of knitting the part E in FIG. 1.
Figure 7:
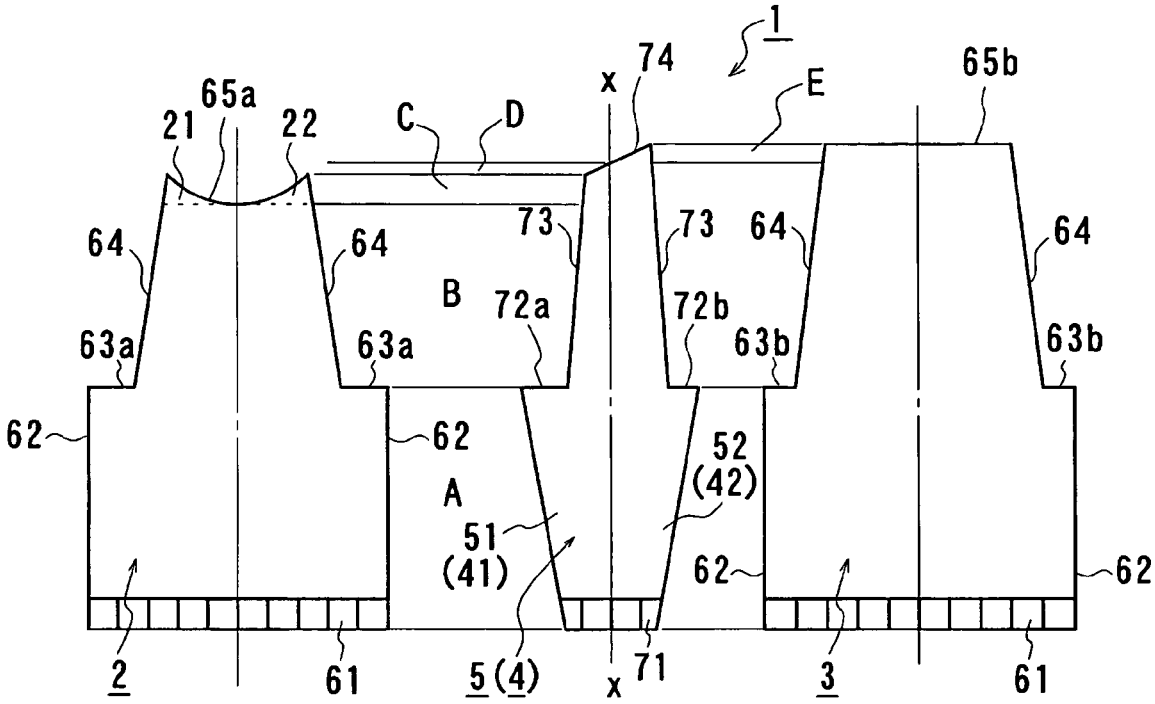
FIG. 7 shows the second embodiment of the knitwear according to the present invention, showing the plan view of the parts of bodies and sleeves of the sweater.
Figure 8:
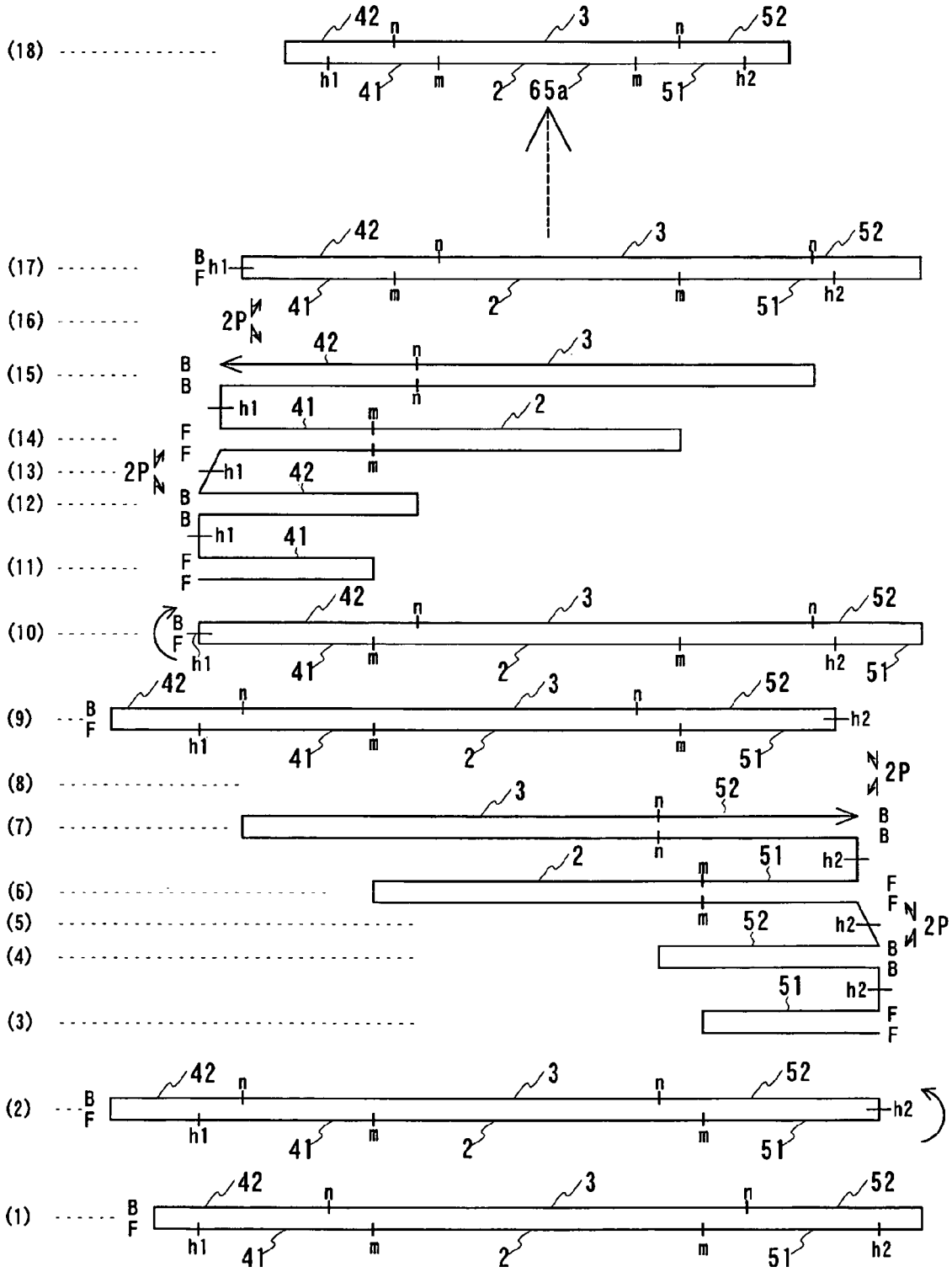
FIG. 8 shows the knitting process drawing of the knitwear of the second embodiment according to the present invention, showing the knitting process drawing of knitting the part B in FIG. 7.
Figure 9:
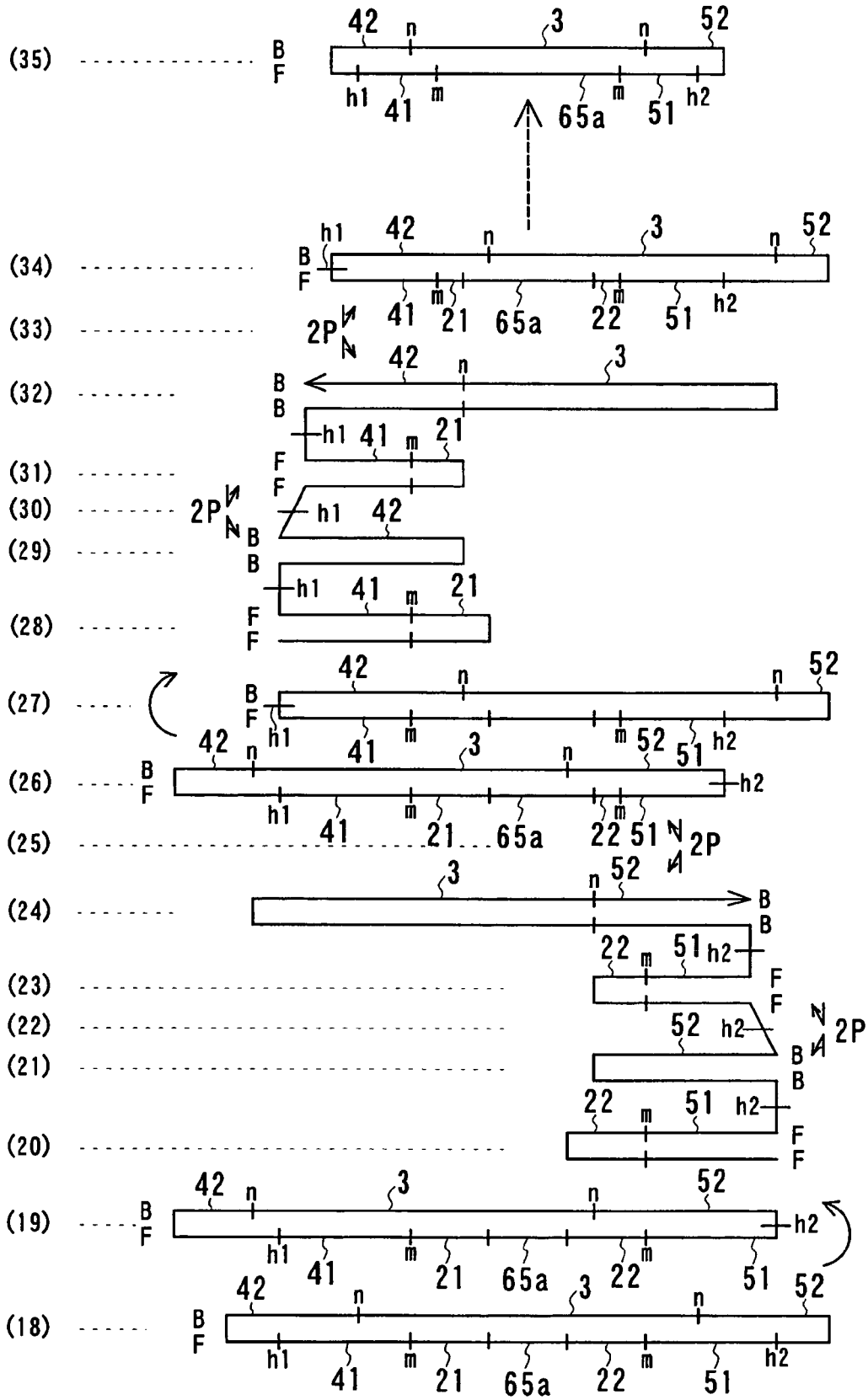
FIG. 9 shows the knitting process drawing of the knitwear of the second embodiment according to the present invention, showing the knitting process drawing of knitting the part C in FIG. 7.
Figure 1:
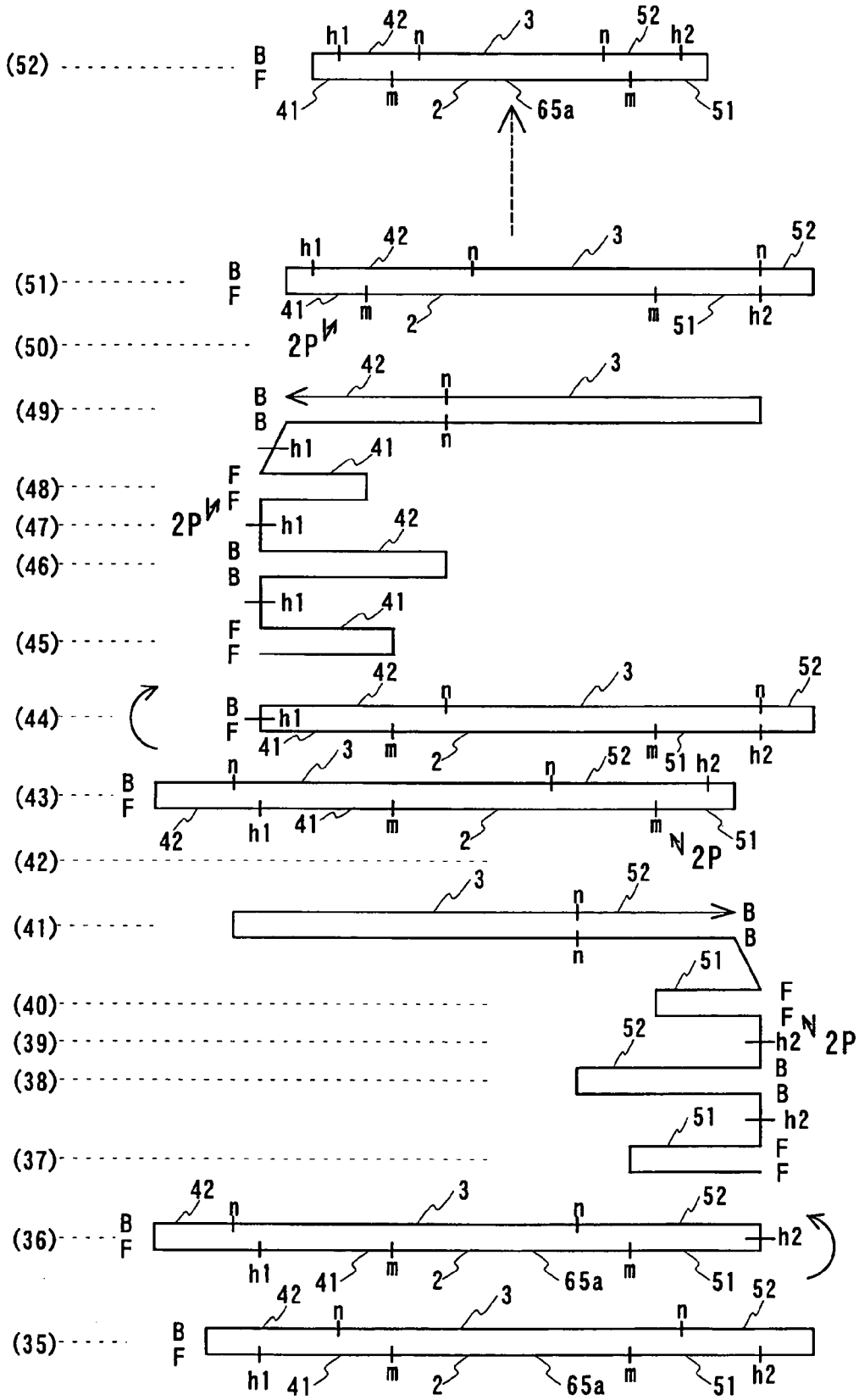
Figure 11A:
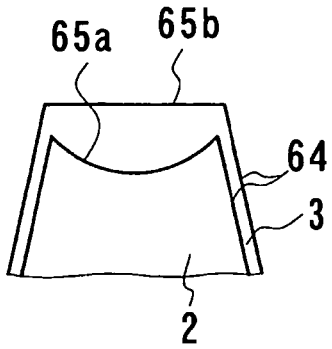
FIG. 11 shows the third embodiment according to the present invention, (a) showing the upper part of the back and front bodies, and (b) showing the condition of the left sleeve on the needle bed when the knitting step is completed.
Figure 11B:
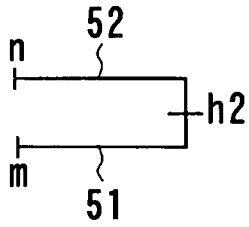
Figure 12A:
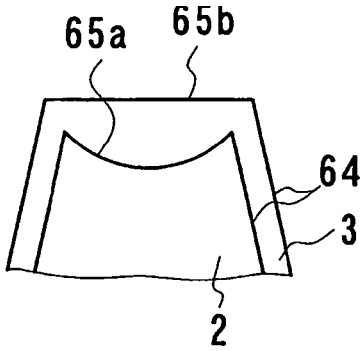
FIG. 12 shows the fourth embodiment according to the present invention, (a) showing the upper part of the back and front bodies, and (b) showing the condition of the left sleeve on the needle bed when the knitting step is completed.
Figure 12B:
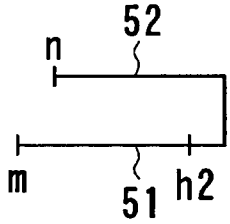
Figure 13:
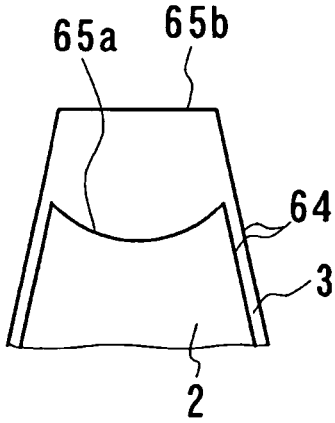
FIG. 13 shows the fifth embodiment according to the present invention, (a) showing the upper part of the back and front bodies, and (b) showing the condition of the left sleeve on the needle bed when the knitting step is completed.
Figure 13:
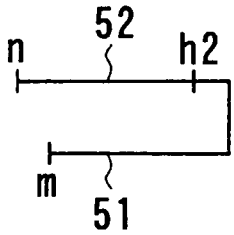
Figure 1:
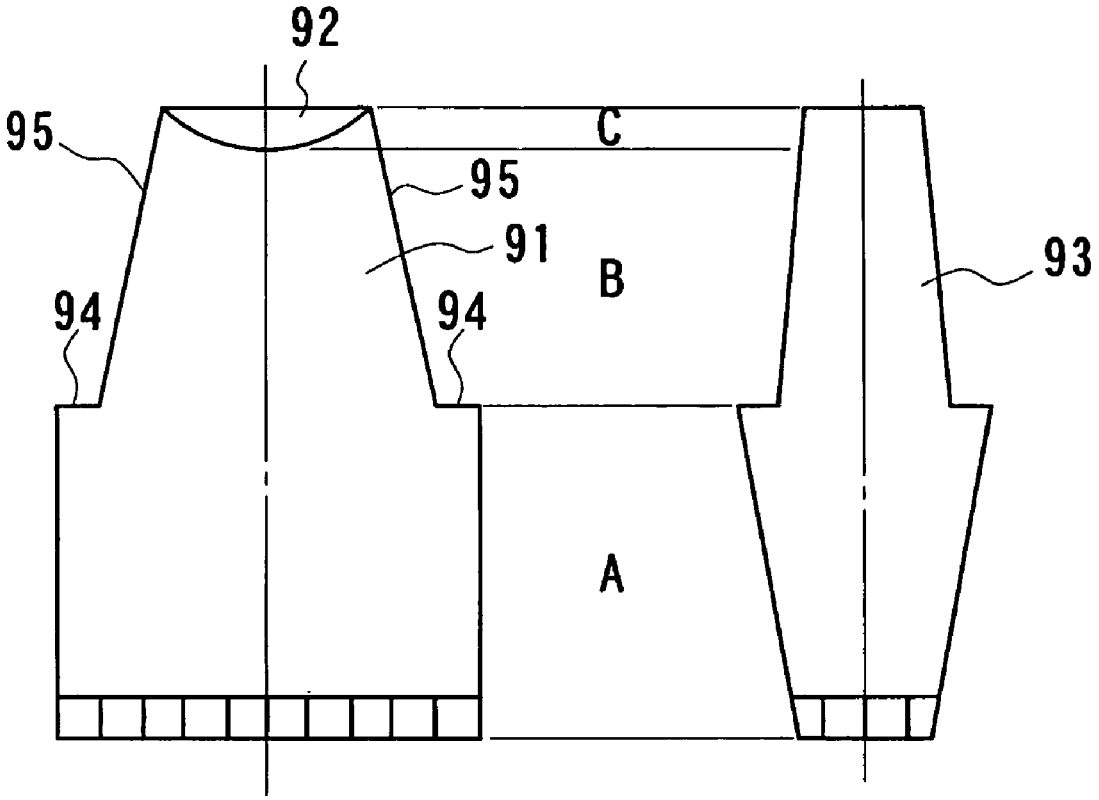

| | | | | | |
|---|---|---|---|---|---|
| 1 | sweater | | | | |
| 2 | front body | 21 | right front body | 22 | left front body |
| 3 | back body | | | | |
| 4 | right sleeve | 41 | right sleeve front part | 42 | right sleeve back part |
| 5 | left sleeve | 51 | left sleeve front part | 52 | left sleeve back part |
| 61 | hem part | 62 | side part | | |
| 63 | gore parts | 63a | front gore parts | 63b | back gore parts |
| 64 | slant-line parts | | | | |
| 65 | neckline | | | | |
| 65a | neckline of the front body | | 65b | neckline of the back body | |
| 71 | cuff parts | | | | |
| 72 | gore parts | 72a | front gore parts | 72b | back gore parts |
| 73 | slant-line joining part | | | | |
| 74 | neckline forming parts | | | | |

The invention claimed is:

1. A method of knitting knitwear with raglan sleeves knitted by using a flat knitting machine having at least a pair of front and back needle beds extending in a transverse direction and disposed opposite to each other in a cross direction, at least either of which is capable of being racked in the transverse direction so that loops can be transferred between the front and back needle beds, wherein:

a length of a back body is formed to be longer than a length of a front body, while the bodies and the sleeves are knitted, the sleeves and the front and back bodies are joined, and after the sleeves and the front body are joined, the following steps are repeated, the step 1 that with a boundary between a front sleeve part and a back sleeve part located on one side placed between a pair of the front and back needle beds, a neckline forming part of the sleeve on the one side is knitted together with the back body, while a knitting width of the neckline forming part is narrowed by flechage knitting, so that the sleeve on the one side and the back body are joined, the step 2 that with a boundary between a front sleeve part and a back sleeve part located on other side placed between a pair of the front and back needle beds, the neckline forming part of the sleeve on the other side is knitted together with the back body, while a knitting width of the neckline forming part is narrowed by flechage knitting, so that the sleeve on the other side and the back body are joined.

2. The method of knitting knitwear with raglan sleeves according to claim 1, which comprises:

the step 1 that after the boundary of the sleeve on the one side is placed between a pair of the front and back needle beds by rotating a body and at least one of right and left sleeves in one direction on the flat knitting machine, the back body and the sleeve on the one side are knitted, while being joined together, the step 2 that after the boundary of the sleeve on the other side is placed between a pair of the front and back needle beds by rotating a body and at least the other of right and left sleeves in the opposite direction on the flat knitting machine, the back body and the sleeve on the other side are knitted, while being joined together.

3. The method of knitting knitwear with raglan sleeves according to claim 1, wherein:

gore parts are formed on at least on a front knitted fabric of the front and back bodies and sleeves, wherein in case of forming the gore parts on the front and back knitted fabrics, the gore parts of the front knitted fabric of the front body and sleeves are formed larger in size than the gore parts of the back knitted fabric of the back body and sleeves and, wherein the following step a and step b are repeated, before completion of the joining of the sleeves and the front body, the step a that after the boundary of the sleeve on the one side is placed between a pair of the front and back needle beds by rotating a body and at least one of right and left sleeves in one direction on the flat knitting machine, the bodies and the sleeve on the one side are knitted, while being joined together, The step b that after the boundary of the sleeve on the other side is placed between a pair of the front and back needle beds by rotating a body and at least the other of right and left sleeves in the opposite direction on the flat knitting machine, the bodies and the sleeve on the other side are knitted, while being joined together.

4. Knitwear with raglan sleeves knitted by using a flat knitting machine having at least a pair of front and back needle beds which are arranged to extend in a transverse direction and disposed opposite to each other in a cross direction, and at least either of which is capable of being racked in the transverse direction so that loops can be transferred between the front and back needle beds, wherein the body having the tubular sleeves and the side parts are knitted in a seamless manner and the body and the sleeves are joined in a seamless manner, characterized by:

that the length of the back body is formed to be longer than the length of the front body while the neckline forming parts of the sleeves are formed in a slanted manner by flechage knitting.

5. Knitwear with raglan sleeves according to the claim 4, characterized by:

that the gore parts are formed on at least on the front knitted fabric of the front and back bodies and sleeves, wherein in case of forming the gore parts on the front and back knitted fabrics, the gore parts of the front knitted fabric of the front body and sleeves are formed larger in size than the gore parts of the back knitted fabric of the back body and sleeves.

* * * * *